US006813900B2

(12) United States Patent
Sarkisian et al.

(10) Patent No.: US 6,813,900 B2
(45) Date of Patent: Nov. 9, 2004

(54) INTEGRATED AQUA-AMMONIA CHILLER/ HEATER WITH HEATER MODE ABSORBER BY-PASS

(75) Inventors: Paul Sarkisian, Boulder City, NV (US); Uwe Rockenfeller, Boulder City, NV (US)

(73) Assignee: Rocky Research, Boulder City, NV (US)

( * ) Notice: Subject to any disclaimer, the term of this patent is extended or adjusted under 35 U.S.C. 154(b) by 0 days.

(21) Appl. No.: 10/753,930

(22) Filed: Jan. 8, 2004

(65) Prior Publication Data

US 2004/0144121 A1 Jul. 29, 2004

Related U.S. Application Data

(63) Continuation-in-part of application No. 09/479,277, filed on Jan. 5, 2000, now Pat. No. 6,718,792.

(51) Int. Cl.[7] ..... F25B 15/00
(52) U.S. Cl. ..... 62/324.2; 62/476
(58) Field of Search ..... 62/101, 324.2, 62/476, 495, 497

(56) References Cited

U.S. PATENT DOCUMENTS

| | | | | | |
|---|---|---|---|---|---|
| 3,826,104 | A | * | 7/1974 | Lamb et al. | 62/149 |
| 4,178,989 | A | | 12/1979 | Takeshita et al. | 165/62 |
| 4,646,541 | A | | 3/1987 | Reid, Jr. et al. | 62/476 |
| 5,282,369 | A | | 2/1994 | Ohuchi et al. | 62/476 |
| 5,363,668 | A | | 11/1994 | Nakao et al. | 62/141 |
| 5,367,884 | A | | 11/1994 | Phillips et al. | |
| 5,490,393 | A | | 2/1996 | Fuesting et al. | |
| 5,548,971 | A | | 8/1996 | Rockenfeller et al. | |
| 5,617,733 | A | | 4/1997 | Tomita et al. | 62/324.2 |
| 5,794,456 | A | | 8/1998 | Ishiguro et al. | 62/497 |
| 5,799,502 | A | | 9/1998 | Nomura et al. | 62/476 |
| 5,802,866 | A | * | 9/1998 | Ishiguro | 62/324.2 |
| 5,901,567 | A | * | 5/1999 | Suzuki et al. | 62/324.2 |
| 6,487,875 | B1 | * | 12/2002 | Sarkisian et al. | 62/497 |
| 6,584,788 | B1 | * | 7/2003 | Sarkisian et al. | 62/141 |
| 6,705,111 | B1 | * | 3/2004 | Rockenfeller et al. | 62/476 |

* cited by examiner

*Primary Examiner*—Melvin Jones
(74) *Attorney, Agent, or Firm*—Knobbe, Martens, Olson & Bear, LLP

(57) ABSTRACT

An aqua-ammonia chiller/heater apparatus is modified to provide a condenser and absorber refrigerant by-pass during a heater mode.

22 Claims, 2 Drawing Sheets

INTEGRATED AQUA-AMMONIA CHILLER/ HEATER WITH HEATER MODE ABSORBER BY-PASS

RELATED APPLICATIONS

This application is a continuation-in-part of application Ser. No. 09/479,277, filed Jan. 5, 2000 now U.S. Pat. No. 6,718,792.

BACKGROUND OF THE INVENTION

Liquid/vapor absorption systems using ammonia refrigerant, often referred to as aqua-ammonia systems, are well-known in the art. These systems utilize absorber heat exchange or generator/absorber heat exchange (GAX) cycles carried out in absorption refrigeration chillers for supplying cooling, typically in the form of a chilled water supply directed to a hydronic loop cooperating with an indoor coil and other heat exchange components for transferring the cooling effect to the space to be conditioned. The basic components of such a chiller apparatus include an absorber, generator, condenser and evaporator and necessary piping for the ammonia refrigerant and the water-based absorption fluid. The heat to the generator is supplied by a burner, and a circulating pump is required for directing the absorption fluid through the apparatus components. When heating for the conditioned space is required, a separate water heater and tank or a furnace are used. Where the cooling and heating functions are combined in a chiller/heater assembly, two separate burners are used, one for cooling and one for the heating, and separate pumps are required for the two different hydronic loop functions.

In the aforesaid co-pending parent application, there is disclosed an improved and simplified aqua-ammonia absorption apparatus in which the cooling and heating functions are integrated into a single apparatus requiring only one burner for heating the generator and one solution pump for directing absorption fluid through the apparatus. The basic apparatus components are an absorber, a generator, condenser, a heat exchanger capable of functioning as both a condenser and an evaporator, and refrigerant by-pass conduit and valving to provide selective by-pass of the refrigerant from the generator to the heat exchanger without passing through the condenser. In the cooling mode or function, the heat exchanger functions as an evaporator. During a heating mode, the refrigerant from the generator by-passes the condenser and is directed to the heat exchanger which functions as the condenser to provide heat which is recovered for heating a conditioned space, water heating, etc. The aforesaid co-pending application, including the description of the apparatus and its operation, is incorporated herein by reference.

SUMMARY OF THE INVENTION

The present application is directed to a chiller/heater absorption apparatus in which refrigerant from the heat exchanger operating as a condenser in a heater mode of operation by-passes the absorber and is pumped to the generator, improving the heating efficiency of the system by reducing heat loss of the refrigerant to the absorber. In one embodiment using separate generator and rectifier columns, an aspirator device is used to direct a mixture of refrigerant and absorption solution from the rectifier column to the generator column in a chiller mode.

DETAILED DESCRIPTION OF PREFERRED EMBODIMENTS

Figure 1:
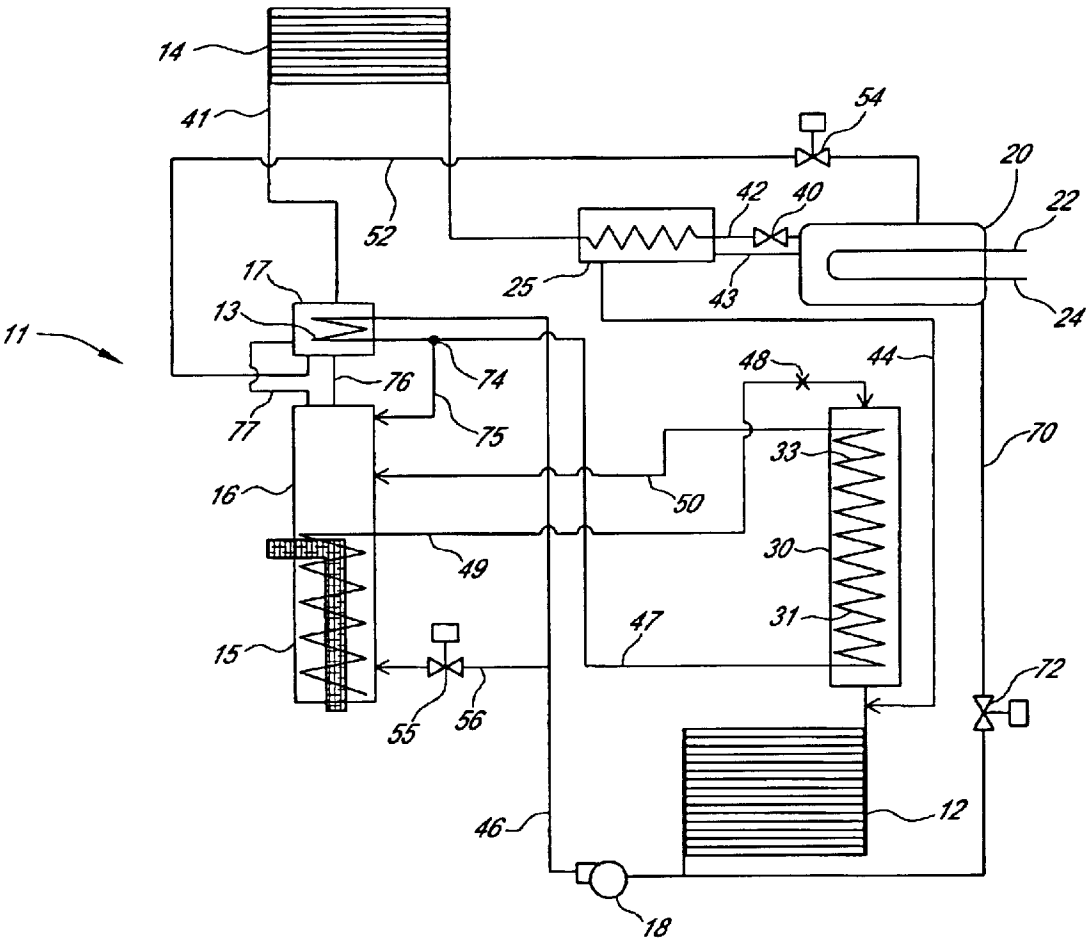
FIG. 1 is a schematic illustration of one embodiment of a GAX chiller/heater illustrating refrigerant absorber by-pass in a heating mode.

FIG. 1 schematically illustrates one preferred embodiment of an aqua-ammonia GAX chiller/heater apparatus. The components of the apparatus shown include an absorber assembly comprising an absorber 12 and an absorber heat exchange section 30 which includes an absorber heat exchanger 31, sometimes referred to as "HCA" or "SCA" and a GAX heat exchanger 33. A generator assembly 11 includes a boiler 15 having a burner for heating and vaporizing the refrigerant, an adiabatic section 16, and a rectifier section 17. The burner may be of a multiple or variable capacity type, and may include a combustion air pre-heater. The use of a variable or multiple capacity burner may be especially desirable in an apparatus of the invention to meet the different energy input levels needed for different cooling and heating function requirements of the chiller/heater. In the apparatus shown, the generator assembly 11 is configured by two separate columns, a generator column 16 housing the boiler 15 and adiabatic section, and a rectifier column 17 housing reflux coil 13. Piping 76 and 77 direct refrigerant between the columns. However, a single column generator as disclosed in the aforesaid application Ser. No. 09/479,277 may be used, as may multiple columns such as disclosed in U.S. Pat. No. 6,385,993, the descriptions of which are incorporated herein by reference.

The apparatus shown includes a condenser 14 and a heat exchanger 20 capable of functioning as an evaporator and as a condenser. The chiller/heater illustrated also includes a subcooler 25 for precooling refrigerant from the condenser with cold gaseous refrigerant from the heat exchanger 19 functioning as an evaporator. A restriction device 40 such as an expansion valve orifice or capillary tube is shown along the refrigerant pipe 42 between the subcooler and the heat exchanger 20. A preferred expansion valve is a pulsed operation thermostatic expansion valve (TXV) described in U.S. Pat. No. 5,675,982, the description of which is incorporated herein by reference. Further description and use of such a valve is also disclosed in co-pending application Ser. No. 10/125,297, filed Apr. 16, 2002 (ROCKYR.104A), also incorporated herein by reference. The absorber and condenser heat exchangers may be air-cooled or liquid-cooled, and the rectifier 17 may be cooled by solution, water or air. The apparatus shown also includes pipe 56 and selectively operated (solenoid) valve 55 connected to pipe 46 for selectively directing refrigerant pumped by solution pump 18 to the generator in a heater mode. An absorption fluid loop includes piping 46 and pump 18 for pumping strong liquor from the absorber 12 to reflux coil 13 and piping 47 for directing a portion of the strong liquor to the absorber heat exchanger 31. The absorption fluid loop is completed by piping 50 for directing the GAXED fluid to the generator. Other GAX or non-GAX absorber embodiments such as disclosed in the aforesaid Ser. No. 09/479,277 application may be used in the alternative. The absorption fluid loop shown also includes weak liquor piping 49 and pressure reduction valve or device 48.

The chiller/heater is operated selectively as a chiller or cooling mode and as a heater. In the chiller mode of operation, selectively operated valve 54 is closed whereby all refrigerant from the rectifier 17 is directed to condenser 14 via piping 41 and thereafter through subcooler 25 and expansion valve 40 into heat exchanger 20 functioning as an evaporator. In the chiller mode, selectively operated valve 72 is closed and refrigerant from heat exchanger 20 is directed to the absorber assembly via piping 43, subcooler 25 and piping 44. Selectively operated valve 55 is closed and refrigerant-rich absorption fluid or rich liquor is pumped from the absorber 12 by solution pump 18 via pipe 46 to reflux coil 13 within rectifier 17 to pipe junction or flow splitter 74 whereby a portion of the absorption fluid is directed to the generator via pipe 75, and a portion to absorber heat exchanger 31 via piping 47. Additional or alternative piping and/or valving may be used for directing the flow of the absorption fluid pumped by solution pump 18 to the rectifier and generator, for example, as described in Applicant's aforesaid application Ser. No. 09/479,277.

In heater operation mode, valves 54, 55 and 72 are opened. Refrigerant is pumped to the generator via pipe 56 by the solution pump 18. Refrigerant vaporized by the boiler 15 in generator section 16 is piped to the rectifier 17. With valve 54 open, by-pass pipe 52 directs the refrigerant from the rectifier to dual function heat exchanger 20 which functions as a condenser to supply heat to heat exchange fluid return and supply pipes 22 and 24, respectively. In the heater mode, with valve 72 open, the condensed refrigerant is pulled directly to pump 18 via piping 70, thereby by-passing subcooler 25 and absorber 12. By so routing the refrigerant to by-pass the absorber, cooling losses which would otherwise occur as the refrigerant passes through ambient temperature absorber 12 are reduced, thereby substantially improving the efficiency of the chiller/heater apparatus in the heater mode. Moreover, in a heater mode, it will be understood that with valves 55 and 72 open, little, if any, absorption fluid is directed through the absorption fluid loop, and instead, refrigerant pumped by pump 18 is directed into the generator column 16 via piping 56, with minimal fluid directed through the piping upstream from pipe 56, including reflux coil 13. The specific piping and valving illustrated is by example only, and other configurations for alternately directing fluid to the generator and rectifier in the different chiller and heater modes, such as described in aforesaid application Ser. No. 09/479,277, may be used.

Figure 2:
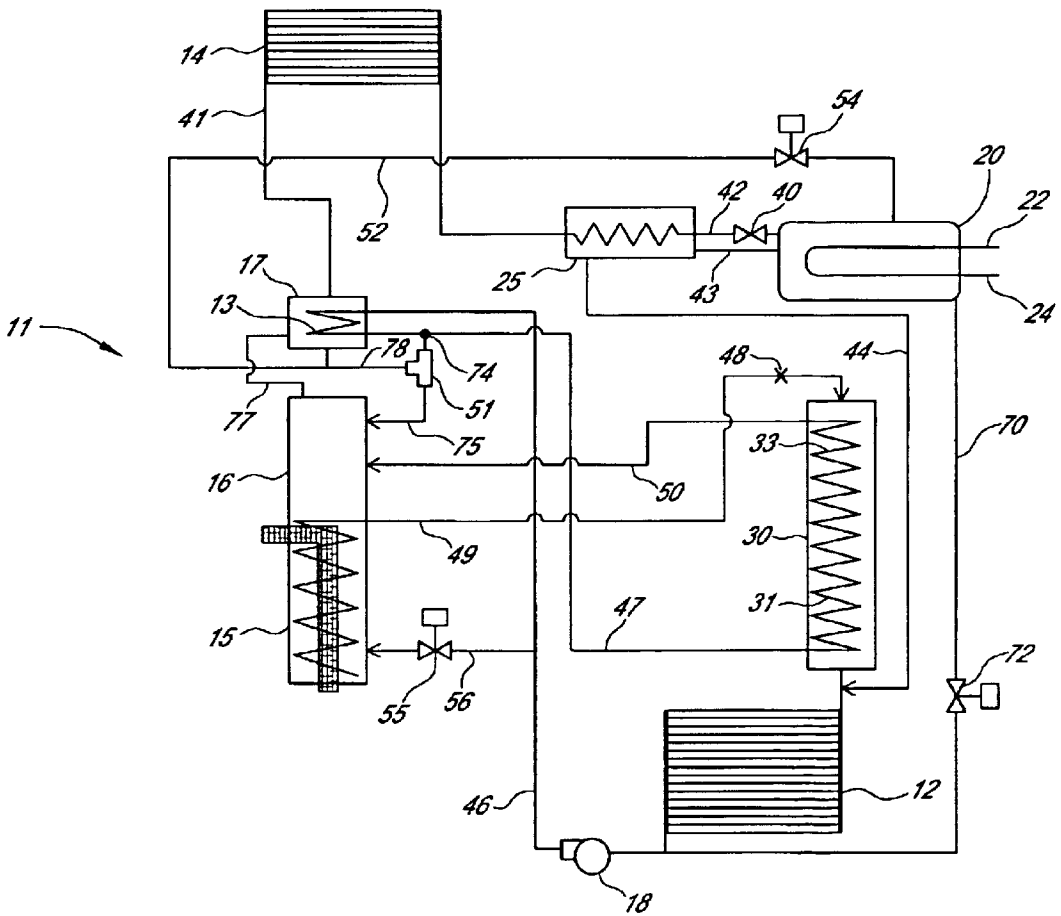
FIG. 2 shows another embodiment of a chiller/heater using an aspirator device for directing a mixture of refrigerant and absorption fluid to a generator column.

In the embodiment of the apparatus illustrated in FIG. 2, an aspirator device 51 is installed along the absorption fluid piping between the reflux coil 13 and generator column 16. A stream of the absorption fluid is directed through the aspirator device which includes an orifice communicating with rectifier column 17 via piping 78. As the stream of absorption fluid passes through the aspirator device, negative pressure created at the orifice by the passing fluid causes refrigerant to be sucked from rectifier 13 via piping 78 which communicates with the negative pressure orifice. Thus, the aspirator device functions to entrain refrigerant from the rectifier and mix it with the absorption fluid, and the mixture is then directed to generator 16 via piping 75. Any such aspirator device, also known as an eductor, ejector or jet pump, may be used for this purpose. The aspirator device is positioned at an elevation high enough relative to the rectifier column 17 and generator column 16 such that in the heater mode the refrigerant from rectifier 17 is drawn to heat exchanger 20 via piping 52 rather than being drawn into the aspirator device 51. By using an aspirator device the rectifier column and generator column may be positioned and operated at the same elevation thereby reducing the profile and height requirements of a generator assembly in which the generator sections and rectifier are commonly housed in a single column. Moreover, the generator assembly may be configured using three different columns and two aspirator devices or eductors, such as described in U.S. Pat. No. 6,385,993, the description of which is incorporated herein by reference. However, such embodiments are optional, as is the use of an aspirator device, and instead, more conventional components such as described regarding FIG. 1 may be used. The piping and valving shown in the preferred embodiments are for illustration only and other equivalent configurations may be used to achieve improved operating efficiency.

What is claimed is:

1. An aqua-ammonia absorption apparatus for selective chiller/heater operation comprising:

an absorber assembly, a generator assembly, a first fluid loop for directing fluid between said absorber and generator assemblies, said first fluid loop comprising first fluid piping for directing fluid from said absorber assembly to said generator assembly and second fluid piping for directing weak absorption fluid from said generator assembly to said absorber assembly;

a condenser, and a heat exchanger for selectively functioning as a condenser or an evaporator;

a refrigerant loop for directing refrigerant between said generator assembly, condenser, said heat exchanger and said absorber assembly;

first refrigerant by-pass piping and valving for selectively directing refrigerant from said generator assembly to said heat exchanger without passing through said condenser;

second refrigerant by-pass piping and valving for selectively directing refrigerant from said heat exchanger to said generator assembly without passing through said absorber assembly; and one solution pump cooperating with said first fluid piping for pumping absorption fluid and refrigerant in said apparatus.

2. Apparatus of claim 1 wherein said second refrigerant by-pass piping directs refrigerant from said heat exchanger to said solution pump.

3. Apparatus of claim 1 or 2 wherein said absorber assembly comprises an absorber, an absorber heat exchanger and a generator absorber heat exchanger.

4. Apparatus of claim 1 wherein said generator assembly comprises a generator and a rectifier, and wherein said first fluid piping includes a first conduit for directing fluid to a reflux coil in said rectifier and a second conduit for directing fluid to said generator.

5. Apparatus of claim 4 including valving cooperating with said first conduit and/or said second conduit.

6. Apparatus of claim 5 wherein said valving comprises a valve for selectively opening and closing said second conduit.

7. Apparatus of claim 1 wherein said generator assembly comprises a generator column and a rectifier column having a reflux coil therein, wherein said first fluid piping comprises a first piping for directing fluid from said solution pump to said reflux coil and second piping for directing fluid from said solution pump to said generator upstream from said reflux coil and valving for selectively opening and closing said second piping, and wherein said first refrigerant by-pass piping connects said rectifier column with said heat exchanger.

8. Apparatus of claim 7 including an aspirator device cooperating with said first fluid loop for directing fluid from said reflux coil and said rectifier column to said generator column.

9. Apparatus of claim 8 wherein said first fluid loop includes a flow splitter downstream from said reflux coil for directing absorption fluid from said reflux coil to said generator column via said aspirator device, and wherein said apparatus includes piping for directing refrigerant from said rectifier to said aspirator device.

10. Apparatus of claim 9 wherein said first fluid loop includes piping for directing absorption fluid from said reflux coil to said absorber assembly.

11. Apparatus of claim 7 wherein said first fluid loop includes a flow splitter downstream from said reflux coil for directing a portion of said absorption fluid from said reflux coil to said generator column and a portion of said absorption fluid from said reflux coil to said absorber assembly.

12. Aqua-ammonia absorption apparatus for selective chiller mode or heater mode operation comprising an absorber assembly comprising an absorber and an absorber heat exchanger, a generator assembly comprising a generator and a rectifier, an absorption fluid loop for directing absorption fluid between said absorber assembly and said generator assembly, one pump cooperating with said absorption fluid loop for pumping absorption fluid and refrigerant in said apparatus, a condenser, a heat exchanger for selectively functioning as an evaporator during a chiller mode and as a condenser during a heater mode, a refrigerant loop for directing refrigerant between said generator assembly, condenser, heat exchanger and absorber assembly, first refrigerant piping and one or more valves cooperating therewith for selectively directing ammonia refrigerant from said rectifier to said heat exchanger without passing through said condenser in a heater mode and second refrigerant piping and one or more valves cooperating therewith for selectively directing refrigerant from said heat exchanger to said generator assembly without passing through said absorber in a heater mode.

13. Apparatus of claim 12 wherein said second refrigerant piping joins said absorption fluid loop downstream from said absorber and upstream from said solution pump.

14. Apparatus of claim 12 or 13 wherein said absorber assembly comprises an absorber, an absorber heat exchanger and a generator absorber heat exchanger.

15. Apparatus of claim 12 or 13 including fluid piping for directing refrigerant from said solution pump to said generator in a heater mode.

16. Apparatus of claim 15 including valving for opening and closing said fluid piping.

17. Apparatus of claim 15 wherein said fluid piping comprises first fluid piping for directing refrigerant from said solution pump to said generator in a heater mode and second fluid piping for directing absorption fluid from said solution piping to said rectifier in a chiller mode.

18. Apparatus of claim 17 including valving for selectively opening and closing said first fluid piping and/or said second fluid piping.

19. Apparatus of claim 12 comprising a generator column and a rectifier column having a reflux coil therein, and wherein said absorption fluid loop includes first piping for directing absorption fluid from said pump to said reflux coil and therefrom to said absorber assembly, and second piping for directing absorption fluid from said reflux coil to said generator column.

20. Apparatus of claim 19 wherein said second piping communicates with said first piping downstream from said reflux coil and upstream from said absorber assembly.

21. Apparatus of claim 19 or 20 comprising an aspirator device cooperating with said second piping whereby a stream of absorption fluid from said reflux coil to said generator column passes through said aspirator device, and third piping for directing refrigerant from said rectifier column to said aspirator device.

22. Apparatus of claim 21 wherein said aspirator device is positioned relative to said rectifier column whereby in a chiller mode a portion of refrigerant from said rectifier column is directed to said aspirator device, and in a heater mode, substantially all of the refrigerant from said rectifier column is directed to said heat exchanger.

* * * * *